United States Patent [19]

Kinoshita et al.

[11] 4,308,334

[45] Dec. 29, 1981

[54] METHOD OF SENSITIZING ZINC OXIDE WITH SENSITIZING DYE AND PHOTOSENSITIVE LAYERS UTILIZING THE SENSITIZED ZINC OXIDE

[75] Inventors: Koichi Kinoshita, Narashino; Ichiro Yoshida, Tokyo, both of Japan

[73] Assignee: Kinoshita Laboratory, Shizuoka, Japan

[21] Appl. No.: 172,056

[22] Filed: Jul. 25, 1980

Related U.S. Application Data

[63] Continuation of Ser. No. 6,941, Jan. 25, 1979, abandoned.

[30] Foreign Application Priority Data

| | | | |
|---|---|---|---|
| Jan. 24, 1978 | [JP] | Japan | 53-6895 |
| Feb. 15, 1978 | [JP] | Japan | 53-16149 |
| Feb. 16, 1978 | [JP] | Japan | 53-16719 |
| Mar. 1, 1978 | [JP] | Japan | 53-23993 |
| Apr. 13, 1978 | [JP] | Japan | 53-43825 |
| May 15, 1978 | [JP] | Japan | 53-57443 |
| Jul. 5, 1978 | [JP] | Japan | 53-82364 |

[51] Int. Cl.[3] ..... G03G 5/087; G03G 5/04

[52] U.S. Cl. ..... 430/89; 430/91; 430/96; 430/130; 430/135

[58] Field of Search ..... 430/91, 92, 93, 130, 430/135, 89

[56] References Cited

U.S. PATENT DOCUMENTS

| | | | |
|---|---|---|---|
| 3,052,540 | 9/1962 | Grieg | 430/91 |
| 3,428,452 | 2/1969 | Giaimo | 430/91 |
| 3,469,987 | 9/1969 | Owens et al. | 430/580 |
| 3,540,886 | 11/1970 | Ansel et al. | 430/87 |
| 3,707,392 | 12/1972 | Honjo et al. | 430/92 |
| 3,907,562 | 9/1975 | Crystal | 430/49 |
| 4,119,461 | 10/1978 | Yamada et al. | 430/88 |

FOREIGN PATENT DOCUMENTS

| | | |
|---|---|---|
| 805616 | 2/1969 | Canada . |
| 1005246 | 9/1965 | United Kingdom . |

*Primary Examiner*—Roland E. Martin, Jr.

*Attorney, Agent, or Firm*—Townsend and Townsend

[57] ABSTRACT

A sensitizing dye and a hydrophilic resin are dissolved in a first solvent, and a second solvent is added to the solution. The second solvent is less volatile than the first solvent, miscible therewith and does not dissolve both of the sensitizing dye and the hydrophilic resin. A powder of the sensitized zinc oxide is incorporated into the solution. After blending, the mixture is dried and pulverized to obtain a powder of sensitized zinc oxide. This powder is then mixed with a bonding agent consisting of a resinous material having an acid value of 5–30 to form a mixture which is formed into a thin photosensitive layer for use in electrophotography.

29 Claims, No Drawings

METHOD OF SENSITIZING ZINC OXIDE WITH SENSITIZING DYE AND PHOTOSENSITIVE LAYERS UTILIZING THE SENSITIZED ZINC OXIDE

This is a continuation of application Ser. No. 6,941, filed Jan. 25, 1979, now abandoned.

BACKGROUND OF THE INVENTION

This invention relates to a method of sensitizing zinc oxide with a dye.

Many types of photosensitive materials utilizing zinc oxide sensitized with a dye have been manufactured and are available on the market. However, their durability is low, that is they can withstand repeated use of at most 100 times. Also their moisture resistance and recovery from light irradiation hysteresis are not always satisfactory. In spite of these defects they have been used for a long time because zinc oxide is inexpensive and easy to sensitize.

Due to poor durability, in recent years zinc oxide has been replaced by selenium type photosensitive materials. The largest factor that governs the durability is the loss of the sensitizing effect of the dye which is termed conduction deterioration. Since the theory of conduction deterioration is still not established, no efficient measure for preventing this effect has yet been proposed.

SUMMARY OF THE INVENTION

It is an object of this invention to provide a novel method of sensitizing zinc oxide with a sensitizing dye.

Another object of this invention is to provide a novel photosensitive layer for use in electrophotography which has excellent moisture resistance and durability.

According to one aspect of this invention there is provided a method of sensitizing zinc oxide with a sensitizing dye, comprising the step of causing the surface of the zinc oxide to absorb the sensitizing dye together with a hydrophilic resin.

According to another aspect of this invention there is provided a method of sensitizing zinc oxide with a sensitizing dye comprising the steps of dissolving a dye and a hydrophilic resin in a first solvent, the resin being adapted to secure the dye to the surface of the zinc oxide, adding to the resultant solution a second solvent to form a mixed solution, the second solvent being less voltatile than the first solvent, miscible therewith and not dissolving both the sensitizing dye and the hydrophilic resin, incorporating a powder of zinc oxide into the mixed solution, and drying the resulting mixture to obtain the sensitized zinc oxide.

According to a still further aspect of this invention there is provided a photosensitive layer for use in electrophotography which is prepared by mixing a powder of zinc oxide sensitized with a dye prepared by the method just described with a bonding agent consisting of a resinous material having an acid value i.e., normality of from 5 to 30 to form a mixture, and then forming the resulting mixture into a thin film.

DESCRIPTION OF THE PREFERRED EMBODIMENTS

We have investigated the principle of the behavior of the sensitizing dye and devised a novel method of preventing loss of the sensitizing effect of the dye based on a hypothesis pertaining thereto. As a result of exhaustive experiment we have invented a novel method of sensitizing zinc oxide with a dye that can not only prevent conduction deterioration but also improve photosensitivity and rapidly diminish the light irradiation hysteresis.

To have a better understanding of this invention one example of this invention will first be described to show the principle thereof and supplemental discussion will follow in connection with another examples.

EXAMPLE 1

2 parts by weight of polyvinyl butryal was dissolved in 100 parts by weight of ethyl alcohol, and 3 parts by weight of Rose Bengal was dissolved in the solution. Then 500 parts by weight of toluene was added to the resulting solution and stirred well. Then 600 parts by weight of a powder of zinc oxide having a mean particle diameter of 0.3 μm was added and the mixture was kneaded in a ball mill for 30 minutes. Then the kneaded mixture was dried by hot air and pulverized thus obtaining a powder of zinc oxide sensitized by the dye.

60 parts by weight of the powder of the sensitized zinc oxide was dispersed in 66 parts by weight of toluene together with 21 parts by weight of an acrylic resin (sold by Dainihon Inki Kagaku Kogyo Kaisha under a trade name of Acrydick) and the solution was coated on a metal sheet to form a photosensitive element having a thickness of 20 μm after drying. When applied to xerography, and charged in the dark to have a surface potential of 400 V, the surface potential of this photosensitive element has attenuated to one half with a light input of 2.6 lx·sec. (lux-seconds), whereas a residual potential of 15 V was observed with a light input of 12.3 lx·sec. Then, in the dark, charging with 400 V and discharging by a light input of 12.3 lx·sec. were repeated and at each 1000 repeated chargings and dischargings the photosensitivity, dark attenuation, etc., were investigated in detail. As a consequence up to 1500 repetitions no change was noted and at 3000 repetitions, although a slight color fading was noted, the characteristics of the photosensitive element did not changed to any appreciable extent. After 7200 chargings and dischargings the light input that is necessary to decrease the surface potential to one half increased to 4.2 lx·sec.

The theory of Example 1 will be described as follows. However, it should be understood that the invention should not be limited to this specific theory.

Although the method of Example 1 is different from the prior art method of manufacturing zinc oxide photosensitive element in that the sensitization with a dye is performed in an independent step and that a dry powder of sensitized zinc oxide is obtained, this does not constitute all the features of this invention, but constitutes one of several efficient methods of carrying out the invention. Ethyl alcohol not only readily dissolves polyvinyl butyral but also acts as an excellent solution for Rose Bengal. As a result of our experiment, however, we have found that there is a physical mutual cooporation between polyvinyl butryal and Rose Bengal. More particularly, ethyl alcohol in which polyvinyl butyral has been dissolved can more readily dissolve Rose Bengal than pure ethyl alcohol. While ethyl alcohol and toluene are miscible at any ratio, polyvinyl butyral and Rose Bengal are difficult to dissolve in toluene. In addition, the surface of zinc oxide is hydrophilic. Thus, when zinc oxide is admixed, groups of molecules in which Rose Bengal diluted with toluene and weakly bonded to molecules of polyvinyl butyral is present are adsorbed by the surface of the zinc oxide. Accordingly, it is considered that the toluene acts merely as a suspension medium. Under these conditions, since alcohol acts as a type of a dispersant the zinc oxide which has adsorbed polyvinyl butyral and Rose Bengal can readily disperse in toluene with the result that respective particles of zinc oxide having absorbed thereon polyvinyl butyral and Rose Bengal suspended in toluene. Since the amount of toluene is larger than that of alcohol, each particle of zinc oxide independently suspends in toluene. When drying is carried out at this point, since the boiling point of ethyl alcohol is lower than that of toluene, ethyl alcohol evaporates preferentially with the result that toluene surrounds the particles of the zinc oxide. Consequently, the molecules of Rose Bengal are mechanically bonded to the surface of the particles of zinc oxide by polyvinyl butyral so that after complete evaporation of toluene, this state of bonding persists in which Rose Bengal is uniformly bonded to the surface of fine particles of zinc oxide.

One object of this invention is to cause the sensitizing dye to be adsorbed on the surface of the zinc oxide in an appropriate state and to mechanically bond the dye to zinc oxide. As is well known in the art the sensitizing dye is in a quasi-stable state because a type of junction barrier is formed by ionic attraction between the dye and the surplus zinc in the zinc oxide. When such attraction is broken by current conduction or light excitation, the molecules of the dye are separated from the surface of the particles of zinc oxide. As such, the molecules of the dye become unstable thus causing so-called conduction fading due to an unexpected chemical change or an irreversible change due to moisture. The purpose of the polyvinyl butyral used in Example 1 is to mechanically prevent disengagement of the molecules of the dye from the surface of zinc oxide. Moreover, since polyvinyl butyral is hydropholic the performance of the Rose Bengal against the zinc oxide would never be influenced by the presence or absence of the moisture. For this reason, the photosensitive material prepared by the process of Example 1 has excellent moisture resistance.

As should be evident from the foregoing description, the invention is not limited to the use of polyvinyl butyral and Rose Bengal as can be further evidenced by the following examples.

EXAMPLE 2

One part by weight of polyvinyl alcohol was dissolved in 180 parts of water. 3 parts by weight of Rose Bengal was also dissolved in the water and 420 parts by weight of ethyl alcohol was added and stirred thoroughly. Thereafter, 600 parts by weight of zinc oxide was added into the solution and the mixture was kneaded in a ball mill for 30 minutes. After removal from the ball mill, the kneaded mixture was dried with hot air, resulting in a powder of sensitized zinc oxide. This powder was coated onto an aluminum substrate to have a dry thickness of 20 μm to obtain a photosensitive element by using a binder comprising a 3:1 mixture of a vinyl chloride-vinyl acetate copolymer having an acid value of 10 (sold by Union Carbide Corp. under a trade name of VMCH) and dissolved in methylisobutyl ketone and a silicone resin (sold by Shinetsu Kagaku Kogyo K.K. under a trade name of KR-214). The characteristics of this photosensitive element did not changed in any appreciable amount even after xerographic image forming steps had been repeated more than 10000 times. Further, the photosensitive element was exceedingly moisture proof and had excellent sensitivity and recovery from light irradiation hysteresis.

In this Example, the Rose Bengal was used as an example of conventional dyes which show a large color fading. Although any dye may be used in this invention, where it is desired to sensitize the zinc oxide with a single synthesizing step, a P type dye should be selected. Among suitable P type dyes may be mentioned phloxine B, uranine, Rose Bengal, erythosine, eosine, rhodamine-B, fuchsine, fluorescein, acrylic diorange, etc. Some examples of the hydrophilic resins utilized in this invention are polyvinyl butyral, polyvinyl formal, polyvinyl alcohol, polyvinyl methylether, polyvinyl ethylether, polyvinyl pyrrolidine, methyl cellulose, ethyl cellulose, nitrocellulose, cyanoethyl cellulose and polyacrylamide.

It should be understood that the invention is not limited to the use of a single dye layer bonded to the surface of the particles of the zinc oxide. For example, if necessary, a P type dye later may be firstly bonded to the surface of the zinc oxide particles and then an N type dye layer may be secured. As an example, Rose Bengal is bonded to the surface of the zinc oxide particles by using polyvinyl alcohol and then methylene blue may be bonded by using polyvinyl butyral.

In the following Example 3, two types of solvents are used, one dissolving the sensitizing dye and a resin utilized to bond the dye to the surface of the particles of zinc oxide and the other which does not dissolve both the sensitizing dye and the resin but miscible with the first solvent, the latter solvent having a lower volatility than the former.

EXAMPLE 3

100 parts by weight of a powder of zinc oxide and having an average particle diameter of 0.3 μm was dried and stored in a sufficiently dried atmosphere. 0.5 parts by weight of Rose Bengal and 0.5 parts by weight of polyvinyl butyral were thoroughly dissolved in 15 parts by weight of ethyl alcohol and then 50 parts by weight of toluene was added to prepare a mixed solution. After incorporating the dried zinc oxide into the mixed solution the mixture was thoroughly kneaded by a ball mill. The kneaded mixture was spread over a glass plate and the solvents were removed by dry hot air thus completing the sensitization with the dye.

In this Example, neither the Rose Bengal nor the polyvinyl butyral dissolves in toluene. Since the surface of the particles of zinc oxide is hydrophilic the Rose Bengal and polyvinyl butyral are well adsorbed by the surface of the zinc oxide due to a specific characteristic of the mixed solvent. For this reason, when dried with hot air the mixture gives a satisfactory photosensitive element. Since the boiling point of ethyl alcohol is 78.3° C., whereas that of toluene is 110° C., and moreover since the quantity of ethyl alcohol is sufficiently smaller than that of toluene, during drying the ethyl alcohol preferentially evaporates so that the percentage of the residual toluene increases. As above described, since both Rose Bengal and polyvinyl butyral are not soluble in toluene they deposit on the surface of the particles of the zinc oxide. After completing the evaporation of ethyl alcohol, since toluene still remains about the particles of the zinc oxide, the polyvinyl butyral forms coatings about discrete particles of the zinc oxide. With this method, since precolored powder can be obtained so long as the kneading is carefully carried out so as to obtain a homogeneous mixture, such homogeneity would be maintained even after pulverization.

The miscibility of ethyl alcohol and toluene is an essential condition for the molecular dispersion of Rose Bengal and polyvinyl butyral. Where a combination of solvents which are not miscible with each other is selected, so-called colloids would result in which one of the solvents suspends as minute particles in the other solvent. Under such conditions the particle size of the colloid being equal to or larger than that of the zinc oxide, it becomes impossible to uniformly sensitize the zinc oxide with the dye. Due to the physical property of collide, it is difficult to prepare suspended particles having a smaller size than that of the zinc oxide unless an additional surfactant is used. For the reason described above, it will be understood that the miscibility of the two solvents is an essential condition.

Of course the invention is not limited to the specific combination of the materials described in this example. In Example 3, Rose Bengal is used as a typical example of the sensitizers commonly used to sensitize the zinc oxide. It is possible to substitute the Rose Bengal with a corresponding amount of such coloring materials as eosine, erythrosine and phloxine. Also, polyvinyl butyral may be substituted with another resin as polyvinyl formal, polyvinyl alcohol and polyvinyl pyrrolidone, and ethyl alcohol may be substituted with such other solvents as methyl alcohol, tetrahydrofuran, and methyl acetate. Furthermore, toluene may be substituted with such second solvent as xylene, cyclohexane, trichloroethane, tetrachloroethylene, etc.

Although an Example 3, the pre-coloring was performed before the powder of the sensitized zinc oxide was obtained, the invention is not limited to this special process as shown in the following example.

EXAMPLE 4

A liquid mixture was prepared by using ingredients at the same proportions as in Example 3. Then the mixture was heated to 90° C. for 60 minutes while stirring. When the amount of toluene becomes short during stirring it is supplemented. When the mixture is sufficiently heated, ethyl alcohol has been completely evaporated. In this state, a powder of the pre-colored zinc oxide is suspending in toluene. After incorporating a binder the mixture was thoroughly blended to prepare a photosensitive element which also showed excellent characteristics.

The fixing of the dye with a hydrophilic resin in accordance with the method of this invention utilizes the physical bonding effect and the high affinity of the hydrophilic resin. Where an anion is incorporated into the mixture more durable photosensitive element can be obtained as shown by the following example.

EXAMPLE 5

100 parts by weight of a powder of zinc oxide having an average particle size of 0.3 μm was thoroughly dried. 0.5 parts by weight of Rose Bengal was dissolved in 15 parts by weight of methyl alcohol and then 0.05 parts by weight of sodium oleate was incorporated into the solution. Then 50 parts by weight of toluene was added to the resulting solution and thoroughly stirred. Then, 100 parts of dried zinc oxide powder was added and the mixture was sufficiently kneaded in a ball mill and then spread into a sheet having a suitable area. The sheet was dried with hot air thus completing sensitization. This sensitized zinc oxide was formed into a thin layer by using a suitable binder which was used to prepare a photosensitive element having excellent durability and moisture resistance.

Although the function of the anion is not yet clearly understood, it is believed that metal ions such as Na, K and Mg perform an important role. Furthermore, although there is no established theory regarding deterioration of the sensitizing dyes it has already been confirmed by experiment that repeated light excitation and current conduction result in the decomposition of the dyes and that humidity accelerates deterioration.

Although physically bonded by the hydrophilic resin when excited by a light input and during an interval subsequent to such excitation the molecules of the Rose Bengal become unstable, and the metal ions, such as Na, contained in the molecules of the anion contribute to the rapid recovery of the molecules of Rose Bengal from their unstable state thereby increasing their durability.

The advantage of the combination of an anion with the hydrophilic resin is proven by the fact that the advantage of such anions is never manifested in the absence of hydrophilic resin.

Examples of the anions which can be used in this invention are sodium oleate, potassium oleate, sodium lauryl sulfate, sodium sulfates of high grade alcohols, etc. Generally stated, anions in which an aliphatic acid and an alkaline metal are bonded together are all effective. The hydrophilic resin utilized in this invention is selected from the group consisting of polyvinyl butyral, polyvinyl formal, polyvinyl pyrolydon, methyl cellulose, and polyvinyl alcohol, whereas the sensitizing dye is selected from the group of P-type dyes consisting of Rose Bengal, erythrosine, eosine, uranine, phloxine, rhodamine B and fluorescein.

Most suitable bonding agents utilized to shape the powder of the zinc oxide sensitized as above described into a thin layer are such bonding agents having a high acid value as copolymers of vinyl chloride and vinyl acetate copolymerized with maleic acid and having an acid value of 15 (sold by Union Carbide Corporation under a trade name of VMCA), and an acrylic resin having an acid value of 10 (sold by Dai Nippon Inki Kagaku Kogyo Co. under a trade name of Acrydick 744-590). The effectiveness of the bonding agent having high acid values is believed to be caused by the following facts. The main terminal functional groups of the hydrophilic resin containing sensitizing dye comprise hydroxy groups which adsorb acid radicals. Accordingly, the bonding agent and the sensitized zinc oxide are bonded together with no air gap therebetween. If air gaps present between the bonding agent and the zinc oxide water enters into the gaps with the result that the molecules of the zinc oxide would be surrounded by water as the humidity increases whereby electric field would not act upon the zinc oxide. On the other hand, when the bonding agent is closely bonded to the surface of the particles of the zinc oxide, not only is this defect obviated but also the possibility of the displacement of the molecules of the sensitizing dye is minimized thus increasing the moisture proofness and the durability.

EXAMPLE 6

0.6 parts by weight of Rose Bengal, 0.4 parts by weight of polyvinyl butyral and 0.015 parts by weight of sodium oleate were incorporated into 10 parts by weight of methyl alcohol to form a solution and 50 parts by weight of xylene was added to the solution and stirred. Then 60 parts by weight of zinc oxide was added to the mixed solution and the mixture was thoroughly kneaded in a ball mill. The kneaded mixture was taken out from the ball mill and the solvents were evaporated off with hot air followed by drying for 30 minutes in an atmosphere maintained at 80° C. thus resulting in a sensitized powder of zinc oxide.

28.3 parts by weight of a copolymer (sold by Union Carbide Corporation under a trade name of VMCA) which was copolymerized with maleic acid having an acid value of 15 was dissolved in 120 parts by weight of methylisobutyl ketone. Then 100 parts by weight of sensitized zinc oxide was incorporated into the resulting solution and the mixture was thoroughly stirred to obtain a coating liquid. This liquid was coated on an aluminum substrate and dried to form a photosensitive layer having a thickness of 15 μm, thus obtaining a photosensitive element. When this photosensitive element was used in xerography a sufficiently intense picture image could be obtained when it is charged to have a surface potential of −400 V. The dark attenuation of this element was such that about 90% of the surface potential was preserved after 10 seconds and that the surface potential has decreased to about 20 V by a light irradiation of 12 lx·sec. When mounted on a copying machine provided with a conventional developing device, a transfer device and a cleaning device, the photosensitive element could provide copies having sufficient contrast and resolution. After repeated use of the photosensitive element in a room having room temperature and mean relative humidity of 60% to prepare 10,000 copies, the characteristics of the photosensitive elements were examined. There was no visible variation in the appearance of the surface of the photosensitive element, and sensitivity did not change, but it was found that the dark attenuation was slightly increased such that about 75% of the surface potential was preserved. Even after operation for such long period, the photosensitive element could prepare copies having a quality comparable with that of the copies prepared in the early stage of use. An identical photosensitive element was operation in a room having a relative humidity of 85–95% and a temperature of 25°–35° C. At a time when about 10,000 copies have been prepared, small white spots appeared in the black portions of the picture image. It was found that this was caused by the seepage of low resistance material entrained in the copying paper at the time of making the same and that such material is transferred on to the surface of the photosensitive element at the time of transfer printing. During the course of investigating this cause it was found that at an extremely high room temperature ozone generated by corona discharge oxidizes nitrogen in air and the resulting nitrogen oxide is dissolved in water thus causing contamination. However, this contamination is negligibly small when compared with that transferred from the copying paper. Although, when a high quality copying paper is used the number of the white spots described above decreases, for the purpose of completely eliminating the white spots, at each 500th copy the photosensitive element was washed with aqueduct water. Even immediately after washing with water so long as dew formation can be prevented, the photosensitive element can operate without any trouble to produce satisfactory copies. After repeating this procedure various characteristics of the photosensitive element were examined when the 10,000th copy was prepared. It was found that the variation of the characteristic was smaller than in a case when the photosensitive element was operated continuously at a relatively low relative humidity, that the sensitivity did not change, and that the dark attenuation was unexpectedly improved, that is 83% of the surface potential was preserved after 10 seconds.

As can be noted from the foregoing examples, the photosensitive element has greatly improved durability and resistance to moisture caused deterioration over conventional photosensitive elements including prior art zinc oxide. The moisture proofness is far beyond what would be expected. More particularly, when a classical sensitized zinc oxide photosensitive element is dipped in water or alcohol, the sensitizing dye would dissolve whereby the photosensitive element would become inoperative. In contrast, in the photosensitive element of this invention, water or alcohol does not degrade the element since the water or alcohol does not dissolve the vinyl chloride-vinyl acetate copolymer utilized as the bonding agent.

The anion utilized in Example 6 is not an indispensable element. The bonding agent utilized in this invention comprises such natural or synthetic resins containing acid radicals insoluble in water and alcohol as vinyl chloride-vinyl acetate copolymer, acrylic resin, polyester resins, styrene maleic resin, alkyd resin, etc., and a preferred range of the acid value of such resins is from 5 to 30.

According to this invention a silicone oil is added to the bonding agent utilized to form a powder of zinc oxide sensitized with a dye. Example 7 shows this example.

EXAMPLE 7

0.3 parts by weight of polyvinyl butyral was dissolved in 100 parts by weight of methyl alcohol and then 0.4 parts by weight of Rose Bengal was dissolved. Further 0.03 parts by weight of sodium oleate was dissolved in the resulting solution followed by addition of 60 parts by weight of xylene. While stirring 60 parts by weight of a powder of zinc oxide which had been dried sufficiently and having an average particle size of 0.3 μm was added to the solution. Then the resulting mixture was kneaded in a ball mill for 30 minutes. After being taken out from the ball mill, the mixture was spread on a suitable plate and then dried to obtain a zinc oxide sensitized with the Rose Bengal. Then, 6.4 parts by weight of a vinyl chloride-vinyl acetate copolymer having an acid value of 10 (sold by Union Carbide Corp. under a trade name of Vinylite VMCH) was dissolved in 25 parts by weight of methylisobutyl ketone. Then, 3 parts by weight of a silicone resin intermediate (sold by Shinetsu Kagaku Kogyo K.K. under a trade name of Shinetsu Silicone KR214) and a silicone oil having a viscosity of 50 centistokes were added and thoroughly blended to obtain a mixed solution. On the otherhand, 60 parts by weight of said zinc oxide sensitized with the dye incorporated into 60 parts by weight of toluene was kneaded in a ball mill for 20 minutes. Thereafter, 28.5 parts by weight of said mixed solution of vinyl chloride-vinyl acetate copolymer and silicone oil were added to the kneaded mixture, and kneading was continued for 10 minutes to obtain a coating composition. This coating composition was coated on the surface of an aluminum foil to a dry thickness of 15 μm and then dried with hot air thus completing a photosensitive element. When used in xerography, this photosensitive element showed an excellent charging performance in the dark. Thus, the dark attenuation of the deposited charge was small so that the surface potential has decreased to less than 30 V under light irradiation of 12 lx·sec. Moreover the recovery speed from light irradiation hysteresis was very fast.

This photosensitive element was mounted on a commercial copying machine and operated with a light input of 10 lx·sec. No deterioration of the characteristics was noted during repeated operations of 3000 times. It was found that, even after operations of 10,000 times, the photosensitive element can be used satisfactorily by merely increasing the light input to 12 lx·sec. Then, the relative humidity was increased to 85% and the copying operation was repeated. Under these adverse conditions satisfactory copies were obtained even after 7,000 operations.

The photosensitive element of this example has greater durability and moisture proofness than the prior art zinc oxide photosensitive element. Although various ingredients incorporated in this example have specific meanings, the most important is a specific precoloring step by which the sensitizing dye is fixed by the polyvinyl butyral resin. Incorporation of the silicone oil contributes to the improvement of the durability and moisture proofness of the photosensitive element together with the effect of the method of sensitizing with the dye. In particular, the silicone oil decreases the degree of variation of the characteristic of the photosensitive element when it is used repeatedly.

Since, it is not yet fully understood where, the silicone oil is contained in the photosensitive element, it is impossible to theoretically describe the effect of incorporation of silicone oil. However, we presume that the silicone oil fills the voids in the photosensitive element thus preventing deterioration caused by void discharge.

Where a well known classical method of sensitizing with a dye is used, addition of the silicone oil may vary the frictional charging characteristic of the photosensitive element, but it does not greatly improve the durability and moisture proofness as in the present invention. According to this invention, since the step of sensitizing with the dye is an independent step, the silicone oil never affects the basic function of the sensitizing dye. Thus the effect of the added silicone oil is highly unexpected.

As should be apparent from the foregoing description, incorporation of the silicone oil is efficient even when the sodium oleate is not incorporated, since a hydrophilic resin is used for pre-coloring, and this fact has been confirmed experimentally.

The reason that the silicone resin is particularly efficient may be attributable to the linear structure of the oil. As is well known in the art silicone oil has a special behavior in that it does not prevent the mobility of electric charge. For this reason, it is similarly unexpected that silicone oil can be added without decreasing the sensitivity and other characteristics of the photosensitive element.

As above described according to this invention since the sensitizing dye is secured to the surface of the powder of the zinc oxide by a hydrophilic resin, hydroxy groups are present on the surface of the particles of the sensitized zinc oxide. In order to uniformly disperse such powder and to cause the bonding agent to perfectly adhere to the particles, it is advantageous to use a bonding agent containing acid radicals.

Examples of the bonding agents which contain carboxylic radicals and which can be advantageously used to prepare zinc oxide photosensitive elements are alkyd resins, acrylic resins, polyester resins, vinyl chloride-vinyl acetate copolymers, etc. unsensitized zinc oxide photosensitive elements prepared using these bonding agents can make only several copies under a relative humidity of 85%, for example, and when the relative humidity increases beyond this value the photosensitive elements degrade greatly. As above described, according to this invention the resistance to humidity-caused deterioration and the durability of such photosensitive elements have been improved greatly. Yet further efforts should be continued to realize ideal photosensitive elements that can be used over a long time in an extremely high humidity atmosphere or can operate satisfactorily after a cease in such a high humidity atmosphere.

The deterioration of the characteristics of the zinc oxide photosensitive elements caused by repeated operations under high humidity conditions is attributable to the following two factors. One factor is the fact that the sensitizing dye is rendered ineffective by moisture as has been experienced in the zinc oxide photosensitive element prepared by well known methods. As is well known in the art, the sensitizing dye is effective only when the molecules of the dye are intimately bonded to the surface of the particles of zinc oxide so that when the molecules of the dye are caused to separate from the surface of the particles of zinc oxide or when electrostatic adsorption between the zinc oxide and the dye is caused to be destroyed, the dye becomes rapidly ineffective, thus resulting in such serious failure and color fading as loss of sensitivity. Deterioration caused by this factor is significant in the prior art zinc oxide photosensitive elements. The other factor that deteriorates the image forming characteristic of the zinc oxide photosensitive element under high humidity condition is caused by contaminating substances formed by corona discharge units and contaminating substances oozed from copying papers and transferred to the surface of the zinc oxide photosensitive element. In nearly all cases, the zinc oxide photosensitive element is charged with negative charges when it is used. As is well known, a negative corona discharge unit forms a large quantity of ozone which oxidizes nitrogen in air to form nitrogen oxide. The nitrogen oxide dissolves in water to form nitric acid or nitrous acid, which wets the surface of the photosensitive element. Since nitric acid and nitrous acid have low resistivity they decrease the latent image preserving ability of the photosensitive element thus losing the image forming ability. In addition, under a high humidity condition a large quantity of water soluble substance is transferred from the copying paper to the surface of the photosensitive element. Copying papers utilized in electric photographic copying machines often contain water soluble substances of low resistivity for the purpose of increasing the transfer printing efficiency with the result that there is a large tendency of contaminating the surface of the photosensitive element by copying papers.

According to this invention the first cause of deterioration can be eliminated by improving the bonding force of the sensitizing dye to the zinc oxide. However, deterioration of the image forming characteristic caused by the contamination substance from the copying papers can not be solved by this measure. In many cases, this contamination substance forms white spots on the reproduced picture image. The size and number of the white spots increase with the degree of contamination. In particular, when the photosensitive element is left standing still in a humidity atmosphere for a long time, the contamination substance absorbs a large quantity of moisture and diffuses so that the area of the white spots increases, thus rendering the element inoperative. Even when such water repellent bonding agent as an acrylic resin modified with a silicone is used, the occurrence of the defect can be delayed but not eliminated completely, because the carboxylic radicals of the acrylic acid contained in the silicone modified acrylic resin adsorb the contaminating substance.

To completely solve this problem we propose to treat the photosensitive element with an aqueous solution of ferric chloride for the purpose of eliminating the carboxylic radicals on the surface of the photosensitive element. According to this treatment radical improvement was achieved as shown in the following example.

EXAMPLE 8.

4 parts by weight of polyvinyl butyral, 6 parts by weight of Rose Bengal and 0.15 parts by weight of sodium oleate were dissolved in 125 parts by weight of methyl alcohol and then 600 parts by weight of a powder of zinc oxide was incorporated into the resulting solution. After thoroughly blending the mixture, it was dried with hot air to obtain a powder of zinc oxide sensitized with a dye. This sensitized zinc oxide powder was coated on an aluminum substrate by using a bonding agent consisting of 85 parts by weight of vinyl chloride-vinyl acetate copolymer having an acid value of 15 to obtain a photosensitive element. This element was mounted on a certain type of an electro-photographic copying machine which was operated in atmosphere having a relative humidity of 85%. After 500 copying operations, fine spots were observed. At about 1000th copy, the white spots became larger until about 1/5 of the black portion was occupied by the white spots. Then the operation was stopped and after left standing the machine for 15 hours under 85% relative humidity, the operation resumed. Under this condition, no image could be obtained.

10 parts by weight of ferric chloride was dissolved in 70 parts by weight of water, and then 20 parts by weight of ethyl alcohol was incorporated into the solution to obtain a treating liquid.

Prior to the one, the photosensitive element just described was dipped in this treating liquid for 3 minutes. Then the surface treated photosensitive element was thoroughly washed with water and then mounted on the copying machine described above. The machine was repeatedly operated in an atmosphere having a relative humidity of 85%. It was found that even after 1000 copying operations no degradation of the picture quality was noted and copies obtained by the machine after it has been left standing still for 15 hours under 85% relative humidity had sufficiently high intensity and clearness.

As has been described in connection with Example 8, the treatment with the treating liquid is simple but effective. More particularly before treating with the ferric chloride solution the surface of the photosensitive element is able to be wet by water, but when treated with the ferric chloride solution it becomes water repellent. It is considered that this unexpected result is attributable to the elimination of the carboxylic groups which act as moisture absorbing points.

While Example 8 was described to illustrate an extreme case, even when water repellent property is imparted by using a silicone modified resin as the bonding agent the treatment with the ferric chloride is also effective. For example, when a mixture consisting of 7 parts by weight of vinyl chloride-vinyl acetate copolymer having an acid value of 15 and 3 parts by weight of a silicone modified acrylic resin is used as the bonding agent the surface of the photosensitive element would be imparted with water repellency. Accordingly, the speed of contamination decreases and the quality of reproduced copies did not degraded even after 2000 copies under 85% relative humidity so long as the machine was used continuously. When the copying operation was resumed after the machine had been left standing still for 15 hours under 85% relative humidity, numerous white spots appeared thereby greatly degrading the picture quality. When the same photosensitive element was treated with the ferric chloride solution in the same manner as above described, the white spot did not appear thus assuring high quality picture images.

As has been pointed out before, when used in high humidity atmosphere, the surface of a zinc oxide photosensitive element utilizing a bonding agent containing carboxylic groups is liable to be contaminated by water soluble substances so that the image forming characteristic of the element is caused to degrade by external factors different from the degradation of photosensitive element itself. However, when the photosensitive element is treated with an aqueous solution of ferric chloride, the means for adsorbing the contaminating substances is removed thus improving the moisture resistant property.

According to another method of preventing adsorption of contaminating substances, a silicone resin containing hydroxyl radicals is coated on the surface of a photosensitive layer made of a bonding agent containing carboxylic radicals to form a thin water repellent protective layer which adheres well to the photosensitive layer. The following Example 9 illustrates this modified method.

EXAMPLE 9

A powder of zinc oxide was prepared which has been sensitized with Rose Bengal according to so-called precoloring process. 100 parts by weight of this powder of sensitized zinc oxide, 28.3 parts by weight of VMCA and 64 parts by weight of isobutyl acetate were admixed to obtain a coating liquid. VMCA is a trade name of a vinyl chloridevinyl acetate copolymer having an acid value of 15 and manufactured by Union Carbide Corporation, U.S.A. This coating solution was coated on an aluminum substrate to form a photosensitive film having a dry thickness of 20 $\mu$m thereby obtaining a photosensitive substrate. After thoroughly drying the photosensitive substrate, a solution consisting of 5 parts by weight of a silicone resin sold by Wakker Co. Germany under a trade name of MK, and 95 parts by weight of petroleum benzene was coated on the surface of the substrate, and then dried to obtain a photosensitive element. The silicone resin MK contained 0.9% of hydroxyl groups. This photosensitive element was mounted on a commercially available copying machine. In dry atmosphere having a relative humidity of less than 70%, even after more than 20,000 copies have been prepared no appreciable degradation was noted. When the same photosensitive element was used in high humidity atmosphere i.e., a relative humidity of higher than 85%, no appreciable degradation was noted even after more than 20,000 copying operations provided that maintenance was performed wherein the developing agent and the cleaning brush were exchanged at each 5,000 copies. Where an identical photosensitive element not coated with the silicone resin MK was operated in high humidity atmosphere, the surface of the photosensitive element was contaminated even though the cleaning brush was exchanged at each 100 copies. As a consequence, at about 2,000th copy the picture quality degraded greatly thus becoming inoperative. It was found that coating of the silicone resin MK increased the residual change by only less than 10V, a negligible value.

According to this example, since the film of a silicone resin containing hydroxy groups adheres well to a photosensitive layer bonded by a bonding agent containing carboxyl groups and since the hydroxy and carboxyl groups manifest strong affinity, even a thin film of the silicone resin has a sufficiently high mechanical strength and a uniform thickness.

The bonding agents utilized to prepare sensitized photosensitive layer include, for example, acrylic resin, alkyd resin, polyester resin, styrene-butadiene copolymer, epoxy resin, vinyl chloride-vinyl acetate copolymer, etc. From the standpoint of dispensing property and pot life, advantageous range of the acid value of these resins is from 5 to 30. A preferred range of the hydroxy groups contained in the silicone resin utilized for the surface treatment is from 0.3 to 3.0. Too high percentage of the hydroxy groups decreases the capability of preventing contamination. As the silicone resin for surface treatment is required to exhibit strong water repellency, materials containing higher percentage of the silicone resin are preferred.

It is desired that the surface protective film should be extremely thin, in fact in the order of 1 micron or less. Even with such thin film, the object of this invention can be achieved. The number of suitable silicone resins presently available on the market is small, so that, if desired, a suitable silicone resin may be synthesized.

What is claimed is:

1. A photosensitive layer for use in electrophotography which is produced by preparing a dye sensitized zinc oxide powder by bonding a sensitizing dye as a solid state on the surface of zinc oxide powder with a hydrophilic resin, mixing the dye sensitized zinc oxide powder with a hydrophobic bonding agent consisting of a resinous material having an acid value of from 5 to 30 to form a mixture, said bonding agent containing carboxylic radicals, forming the resulting mixture into a thin film, and applying a layer of a silicone resin on the surface of said thin film, said silicone layer containing hydroxyl radicals of from 0.3 to 3% by weight.

2. A photosensitive layer according to claim 1 wherein the surface of said photosensitive layer is treated with an aqueous solution of ferric chloride.

3. A photosensitive layer for use in electrophotography which is produced by preparing a dye sensitized zinc oxide powder by dissolving a sensitizing dye and a hydrophilic resin in a first solvent to form a resultant solution, said resin being adapted to bond said dye to the surface of the zinc oxide as solid state, adding to said resultant solution a second solvent to form a mixed solution, said second solvent being less volatile than said first solvent, miscible therewith and not dissolving either said sensitizing dye or said hydrophilic resin, incorporating a powder of zinc oxide into said mixed solution to form a resulting mixture, and drying said resulting mixture to obtain the sensitized zinc oxide powder; mixing the sensitized zinc oxide powder with a hydrophobic bonding agent consisting of a resinous material having an acid value of from 5 to 30 to form a different resulting mixture, said bonding agent containing carboxylic radicals; forming the resulting mixture into a thin film; and applying a layer of a silicone resin on the surface of said thin film, said silicone layer containing hydroxyl radicals of from 0.3 to 3% by weight.

4. A photosensitive layer according to claim 3 wherein the surface of said photosensitive layer is treated with an aqueous solution of ferric chloride.

5. A method of preparing a photosensitive layer for use in electrophotography, said method comprising the steps of:

(a) preparing a dye sensitized zinc oxide powder by:
  (i) dissolving a sensitizing dye and a hydrophilic resin in a first solvent, said resin being adapted to provide a mechanical bond between said dye and the surface of zinc oxide powder particles;
  (ii) adding the solution resulting from step (i) to a second solvent to form a mixed solution, said second solvent being less volatile than said first solvent, miscible therewith, and substantially incapable of dissolving said dye and said hydrophilic resin;
  (iii) incorporating zinc oxide powder into said mixed solution; and
  (iv) drying the mixture resulting from step (iii);
(b) mixing said dye sensitized zinc oxide powder with a hydrophobic bonding agent; and
(c) forming the resulting mixture into a thin layer.

6. A method as claimed in claim 5 wherein the dye is selected from the group consisting of phloxine B, uranine, Rose Bengal, erythrosine, eosine, rhodamine B, fuchsine, flourescine, and acrylic diorange.

7. A method as claimed in claim 5 wherein the hydrophilic resin is selected from the group consisting of polyvinyl butyral, polyvinyl formal, polyvinyl methylether, pyrrolidone, ethyl cellulose, nitrocellulose, cyanoethyl cellulose, and polyacrylamide.

8. A method as claimed in claim 5, 6 or 7 wherein the first solvent is selected from the group consisting of ethyl alcohol, methyl alcohol, tetrahydrofuran, and methyl acetate.

9. A method as claimed in claim 5, 6 or 7 wherein the second solvent is selected from the group consisting of toluene, xylene, cyclohexane, trichloroethane, and tetrachloroethylene.

10. A method as claimed in claim 5, 6 or 7 wherein an alkali metal anion is incorporated into the sensitized zinc oxide.

11. A method as claimed in claim 10 wherein the anion is provided by sodium oleate, potassium oleate, sodium lauryl sulfate, or a sodium sulfate of a higher alcohol.

12. A method as claimed in claim 5, 6 or 7 wherein a P type dye layer is firstly bonded on the surface of the zinc oxide particles and then an N type dye layer is secured.

13. A method as claimed in claim 5, 6 or 7 wherein the bonding agent comprises a resinous material having an acid value of from 5 to 30.

14. A method as claimed in claim 13 wherein the resinous material is selected from the group consisting of acrylic resin, alkyd resin, polyester resin, stylene-butadiene copolymer, epoxy resin, and vinyl chloride-vinyl acetate copolymer.

15. A method as claimed in claim 13 wherein a silicone oil is incorporated into the resinous material.

16. A method as claimed in claim 13 wherein the surface of said photosensitive layer is treated with an aqueous solution of ferric chloride.

17. A method as claimed in claim 8 wherein an alkali metal anion is incorporated into the sensitized zinc oxide.

18. A method as claimed in claim 9 wherein an alkali metal anion is incorporated into the sensitized zinc oxide.

19. A method as claimed in claim 8 wherein a P-type dye layer is first bonded on the surface of the zinc oxide particles and then a N-type dye layer is secured.

20. A method as claimed in claim 9 wherein a P-type dye layer is first bonded on the surface of the zinc oxide particles and then a N-type dye layer is secured.

21. A method as claimed in claim 10 wherein a P-type dye layer is first bonded on the surface of the zinc oxide particles and then a N-type dye layer is secured.

22. A method as claimed in claim 11 wherein a P-type dye layer is first bonded on the surface of the zinc oxide particles and then a N-type dye layer is secured.

23. A method as claimed in claim 8 wherein the bonding agent comprises a resinous material having an acid value of from 5 to 30.

24. A method as claimed in claim 9 wherein the bonding agent comprises a resinous material having an acid value of from 5 to 30.

25. A method as claimed in claim 10 wherein the bonding agent comprises a resinous material having an acid value of from 5 to 30.

26. A method as claimed in claim 11 wherein the bonding agent comprises a resinous material having an acid value of from 5 to 30.

27. A method as claimed in claim 12 wherein the bonding agent comprises a resinous material having an acid value of from 5 to 30.

28. A method as claimed in claim 14 wherein a silicone oil is incorporated into the resinous material.

29. A method as claimed in claim 15 wherein the surface of said photosensitive layer is treated with an aqueous solution of ferric chloride.

* * * * *

UNITED STATES PATENT AND TRADEMARK OFFICE

CERTIFICATE OF CORRECTION

PATENT NO. : 4,308,334

DATED : December 29, 1981

INVENTOR(S) : Koichi Kinoshita, Ichiro Yoshida, Japan

It is certified that error appears in the above—identified patent and that said Letters Patent is hereby corrected as shown below:

In column 1, line 49, change "voltatile" to --volatile--.

In column 2, line 41, change "changed" to --change--.

In column 3, line 66, change "changed" to --change--.

In column 5, line 32, change "an" to --in--.

In column 5, line 53, insert the word --a-- between "mixture" and "more".

In column 7, line 41, change "operation" to --operated--.

In column 9, line 2, change "has" to --had--.

In column 10, line 2 put a --.-- after "etc", and capitalize "Unsensitized" as beginning of new sentence.

UNITED STATES PATENT AND TRADEMARK OFFICE

CERTIFICATE OF CORRECTION

PATENT NO. : 4,308,334

DATED : December 29, 1981

INVENTOR(S) : Koichi Kinoshita, Ichiro Yoshida, Japan

It is certified that error appears in the above—identified patent and that said Letters Patent is hereby corrected as shown below:

In column 11, lines 37-38 should read, --Then the operation was stopped and after the machine was left standing for 15 hours under 85% relative humidity,--.

In column 11, line 54, change "has" to --had--.

In column 12, line 9, change "degraded" to --degrade--

In column 12, line 25, insert the word --the-- before "photosensitive".

In column 13, line 7, insert the word --the-- before "2,000th--.

Signed and Sealed this

Twenty-third Day of March 1982

[SEAL]

Attest:

GERALD J. MOSSINGHOFF

Attesting Officer

Commissioner of Patents and Trademarks